US008302335B2

(12) United States Patent
Wang

(10) Patent No.: US 8,302,335 B2
(45) Date of Patent: Nov. 6, 2012

(54) MANUAL BANNER ROLL-UP MECHANISM

(76) Inventor: Chao-Pang Wang, Taipei (TW)

( * ) Notice: Subject to any disclaimer, the term of this patent is extended or adjusted under 35 U.S.C. 154(b) by 345 days.

(21) Appl. No.: 12/819,225

(22) Filed: Jun. 20, 2010

(65) Prior Publication Data

US 2011/0308122 A1 Dec. 22, 2011

(51) Int. Cl.
*G09F 11/30* (2006.01)

(52) U.S. Cl. ..... 40/514; 242/395; 242/396.6; 242/407; 160/319; 160/321

(58) Field of Classification Search ..... 40/514; 242/376, 395, 396, 396.6, 407, 598.3; 160/309, 160/313, 319, 321, 323.1
See application file for complete search history.

(56) References Cited

U.S. PATENT DOCUMENTS 4,525,946 A * 7/1985 Olson ..... 40/514
4,534,396 A * 8/1985 Jung ..... 160/298
5,029,629 A * 7/1991 Cheng-Pei ..... 160/300
5,983,972 A * 11/1999 Chou ..... 160/319
6,739,373 B1 * 5/2004 Liu et al. ..... 160/321
7,497,242 B2 * 3/2009 Wang ..... 160/321
7,549,458 B2 * 6/2009 Kwak ..... 160/319
8,156,993 B2 * 4/2012 Kao ..... 160/321

* cited by examiner

*Primary Examiner* — Tashiana Adams
*Assistant Examiner* — Shin Kim

(57) ABSTRACT

A manual banner roll-up mechanism has a first tube, a second tube, a foldable material, a securing base, a washer, a linking member, a rope, a securing cylinder, a first plug and two mounting supports. The first tube is rolled up with a foldable material. Another end of the foldable material is connected to a second tube. One end of the first tube is jacketed by a securing base, and the washer, the triggering member and the rope are locked onto the securing cylinder by a bolt. Another end of the first tube is jacketed by the first plug that has a base, a positioning member, a spring, and a cover. A first positioning member of the securing base and a second positioning member of the first plug enable the first tube to be hung between the two mounting supports.

4 Claims, 7 Drawing Sheets

MANUAL BANNER ROLL-UP MECHANISM

BACKGROUND OF THE INVENTION

1. Field of the Invention

The present invention relates to a manual banner roll-up mechanism, and more particularly to a mechanism for manually rolling up a flag, banner or poster.

2. Description of the Prior Art

Sales can be promoted by advertisements or other promotional products. Advertisements are shown on TV, radio broadcasts, newspapers, magazines, posters, the Internet or fliers. Promotional products include post cards, bookmarkers, pens, desk calendars, water bottles, color pins and the like. Both advertisements and promotional products are important for improving sales.

However, the most popular commercial advertisements are poster displays, whether indoor or outdoor. Current display banners are hung as a flag, or adhered onto a surface, or clipped onto an object; however, as a result, the advertising effectiveness of the banners or posters may become greatly deteriorated.

Therefore, it is desirable to provide a manual banner roll-up mechanism to mitigate and/or obviate the aforementioned problems.

SUMMARY OF THE INVENTION

An objective of the present invention is to provide a manual banner roll-up mechanism.

The manual banner roll-up mechanism of the present invention comprises a first tube, a second tube, a foldable material, a securing base, a washer, a linking member, a rope, a securing cylinder, a first plug and two mounting supports. The first tube is rolled up with a foldable material, another end of the foldable material is connected to a second tube, one end of the first tube is jacketed by a securing base, the washer, the triggering member and the rope are locked onto the securing cylinder by a bolt, and another end of the first tube is jacketed by the first plug that includes a base, a positioning member, a spring, and a cover. A first positioning member of the securing base and a second positioning member of the first plug enable the first tube to be hung between the two mounting supports. With an engagement between the rope and the triggering member, movement of the rope rotates the triggering member to drive the securing cylinder to rotate the first tube, such that the foldable material can be rolled up into or out of the first tube, and the second tube maintains the stability of the foldable material.

The detailed description and technical contents of the present invention will be explained with reference to the accompanying drawings.

DETAILED DESCRIPTION OF THE INVENTION

Figure 1:
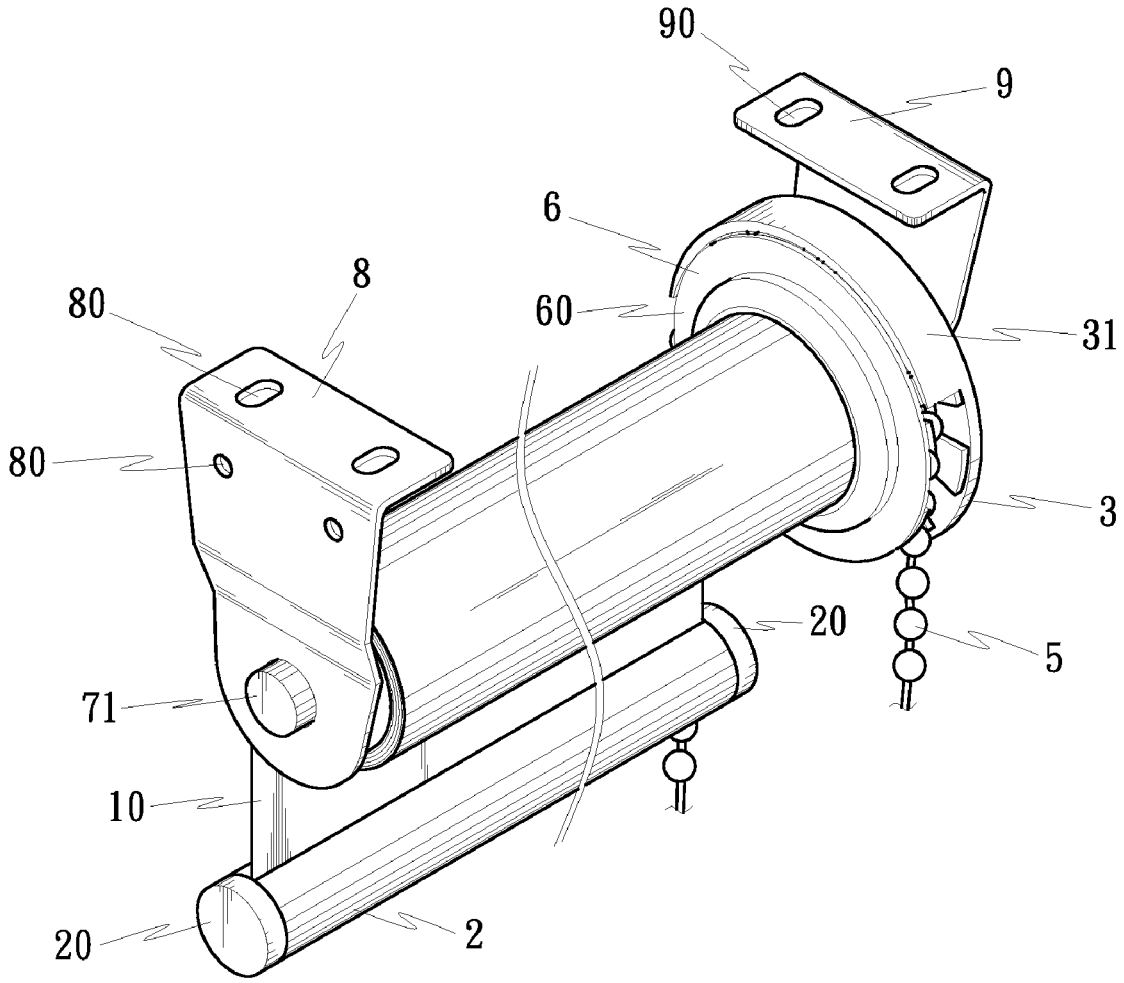
FIG. 1 is a perspective view showing a manual banner roll-up mechanism of an embodiment of the present invention.
Figure 2:
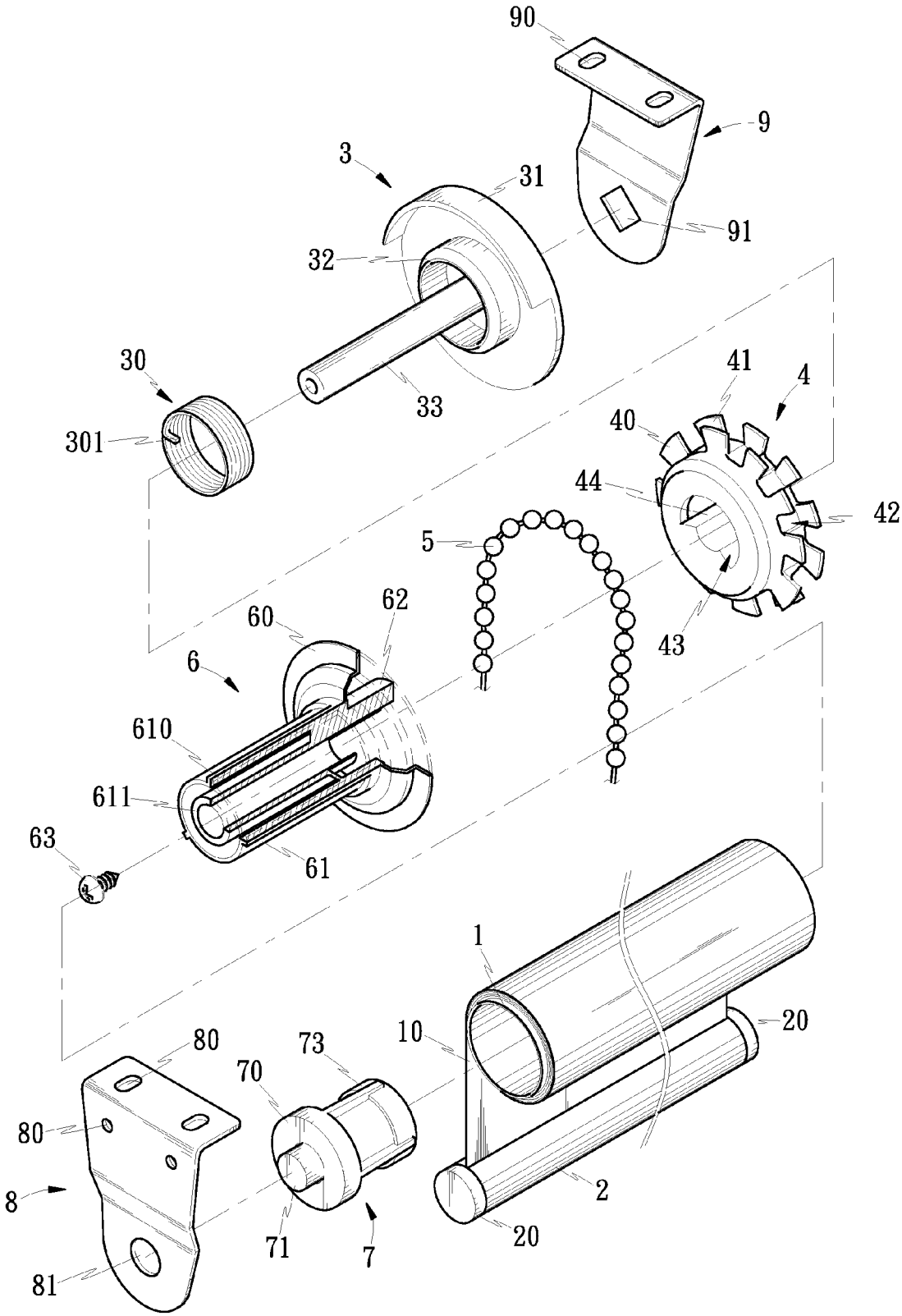
FIG. 2 is an exploded perspective view showing a manual banner roll-up mechanism of an embodiment of the present invention.

First, please refer to FIGS. 1 and 2. A manual banner roll-up mechanism comprises a first tube 1, a second tube 2, a foldable material 20, a securing base 3, a triggering member 4, a rope 5, a securing cylinder 6, a first plug 7 and two mounting supports 8, 9. A foldable material 10 is placed between the first tube 1 and the second tube 2. One end of the first tube 1 is attached onto the securing base 7, and another end of the first tube 1 is attached onto the securing cylinder 6, the rope 5, the triggering member 4 and the securing base 3. The first tube 1 is mounted between the mounting supports 8, 9, and the rope 5 causes the first tube 1 to generate a rotational movement to roll up or down the foldable material 10 and the second tube 2.

The securing cylinder 6, the rope 5, the triggering member 4 and the securing base 3 are installed on one end of the first tube 1, and the securing base 3 is a round T-shaped base having an arced protector 31, a hollow assembly portion 32 protruding from a center position on one side of the securing base 3 and a hollow rod 33 protruding from the center position on the same side of the securing base 3. An interior space of the assembly portion 32 is capable of accepting the washer 30. The washer 30 is similar as a spring and has a bent end 301 at both ends, which respectively push against the second positioning rod 44 of the triggering member 4 and the third positioning rod 62 of the securing cylinder 6. An outer space around the assembly portion 32 is capable of accepting the triggering member 4, and a rectangular first positioning rod 34 is formed at another side of the securing base 3 (not shown, please see FIG. 3). The first positioning rod 34 is correspondingly accepted in the positioning aperture 91 of the mounting support 9. The triggering member 4 is a casing and has two stopping plates 40, 41 having a plurality of surrounding teeth, and a groove 42 is formed between the two stopping plates 40, 41. The stopping plates 40, 41 and the groove 42 are capable of accepting the rope 5, and the stopping plates 40, 41 are capable of engaging with the rope 5. A through aperture 43 having a fan shape is formed at a center position of the triggering member 4, and a second positioning rod 44 is formed on one side of the triggering member 4. The second positioning rod 44 is placed through the washer 30 of the assembly portion 32 of the securing base 3, while the through aperture 43 is capable of accepting the third positioning rod 62 of the securing cylinder 6, and the triggering member 4 jackets onto the assembly portion 32 of the securing base 3. The rope 5 is made from a plurality of stringed round beads, is placed between the two stopping plates 40, 41 of the triggering member 4, and is used for rotating the triggering member 4. The securing cylinder 6 is a T shape d tube sleeve; a tube section 61 is formed on one side of a base 60, and an inner tube section 611 is coaxially formed in the tube section 61 for accepting the hollow rod 33 of the securing base 3. In addition, a plurality of protrusions 610 are formed around an outer sidewall of the tube section 61, which are placed in one end one of the first tube 1. Furthermore, a fan-shaped positioning rod is formed at another end of the securing cylinder 6 and correspondingly placed in the through aperture 43 of the triggering member 4 to push against the washer 30.

As a result, the securing base 3, the washer 30, the triggering member 4, the rope 5, and the securing cylinder 6 are all assembled together, and a bolt 63 is secured onto the free end of the hollow rod 33 of the securing base 3. After the bolt 63 pushes the securing cylinder 6 against to the securing base 3, the entire structure is placed in one end of the first tube 1. Another end of the first tube 1 is inserted with a first plug 7, so the two ends of the first tube 1 are respectively connected to the first plug 7 and the securing base 3. A second positioning member 71 of the first plug 7 is correspondingly placed in a positioning aperture 81 of the mounting support 8, and the first positioning member 34 of the securing base 37 is correspondingly placed in a positioning aperture 91. After assembly, the rope 5 can be pulled to control the second tube 2 and the foldable material 10 to roll up and down around the first tube 1. One end of the foldable material 10 is attached to the second tube 2, and another end of the foldable material 10 is attached to the first tube 1. The foldable material 10 can be coated or printed with desired design patterns.

Figure 3:
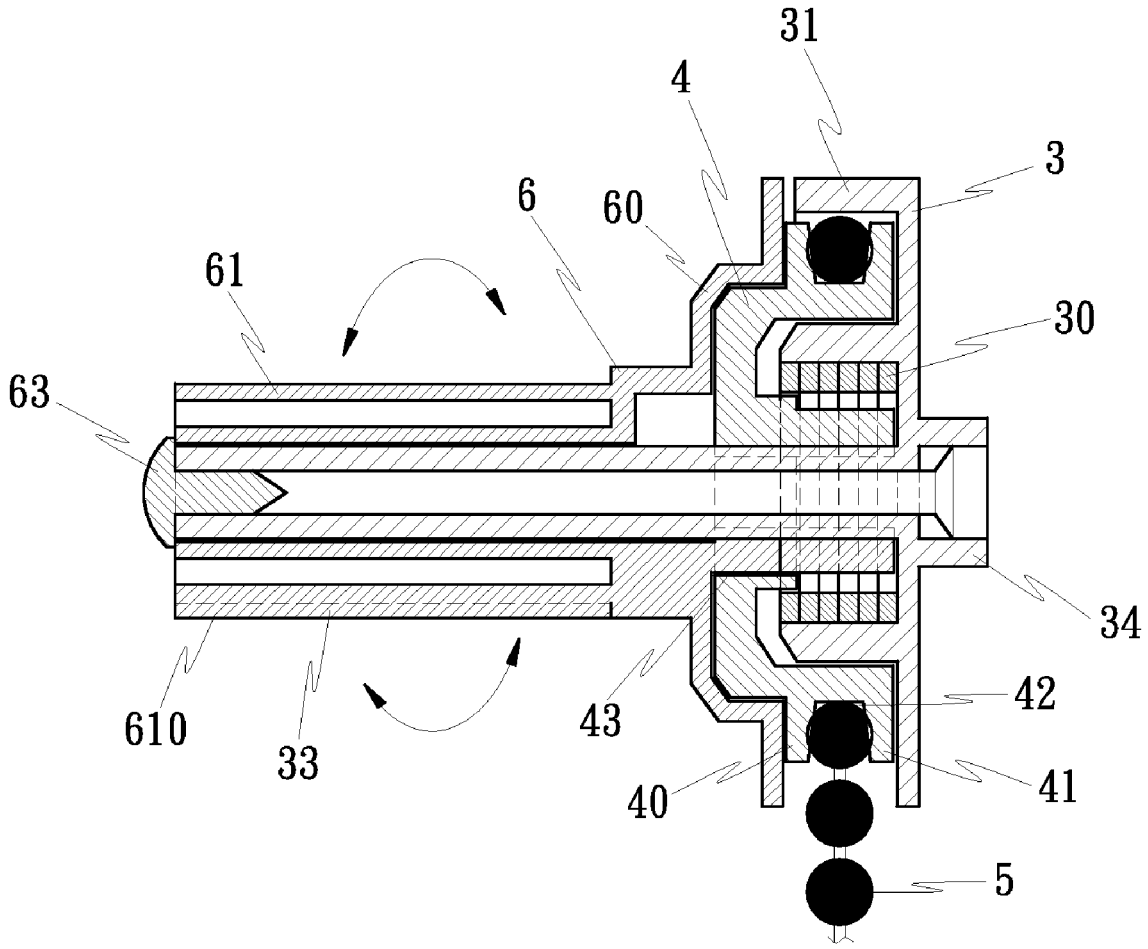
FIG. 3 is a cross-sectional view showing a securing base, a triggering member and a rope of an embodiment of the present invention.

Please refer again to FIG. 3. FIG. 3 is a cross-sectional view showing a securing base, a triggering member and a rope of an embodiment of the present invention. The washer 30 is placed in the inner space of the assembly portion 32 of the securing base 3, and an outer diameter of the washer 30 is equal to an inner diameter of the assembly portion 32. The washer 30 has bent ends 301 at both ends (not shown, please see FIG. 2). When the second positioning rod 44 of the triggering member 4 is placed into one side of the inner sidewall of the washer 30, both sides of the second positioning rod 44 push against the bent ends 301 of the washer 30 to provide resistance and to prevent sliding. Moreover, the securing cylinder 6 is jacketed onto one end of the triggering member 4, and the bolt 63 is secured at one end of the hollow rod 33 of the securing base to prevent the securing cylinder 6 from sliding away. One end of the securing cylinder 6 has the third positioning rod 62 with a fan shape which is correspondingly placed into the through aperture 43 of the triggering member 4 and the securing washer 30 (not shown, please see FIG. 2). When the triggering member 4 rotates due to the rope 5, the securing cylinder 6 also simultaneously rotates.

Figure 4A:
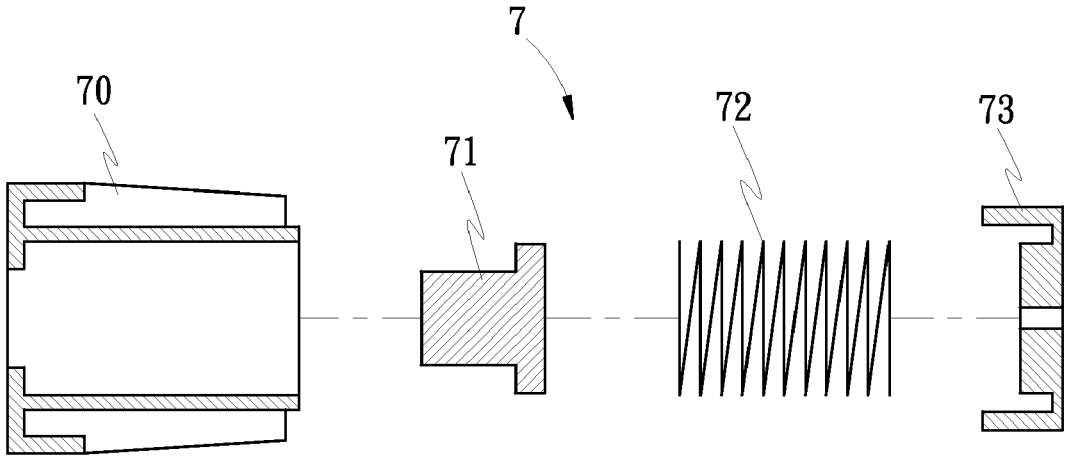
FIG. 4*a* is an exploded cross-sectional view showing a first plug according to an embodiment of the embodiment of the present invention.
Figure 4B:
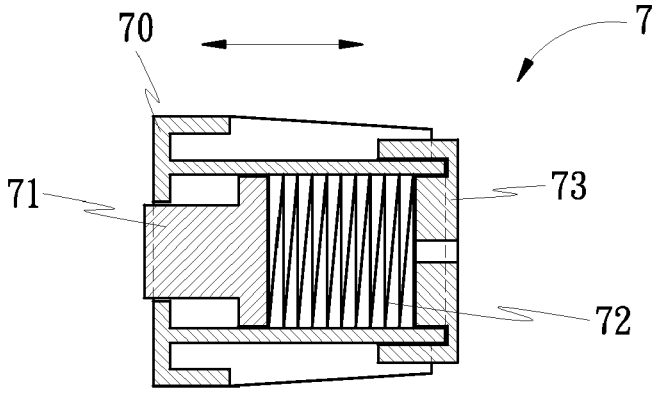
FIG. 4*b* is a schematic view showing movements of the first plug according to an embodiment of the embodiment of the present invention.

Please refer to FIGS. 4*a* and 4*b*. The first plug 7 comprises a base 70, a second positioning member 71, a spring 72 and a cover 73. The base 70 is a substantially hollow tube section having a plurality of inclined ribs and is placed into one end of the first tube 1 (not shown, please see FIG. 6). A diameter of one end of the base 70 is larger than a diameter of another end of the base 70; the second positioning member 71 is positioned with the end having the larger diameter and passes through the other end having the smaller diameter.

Figure 5:
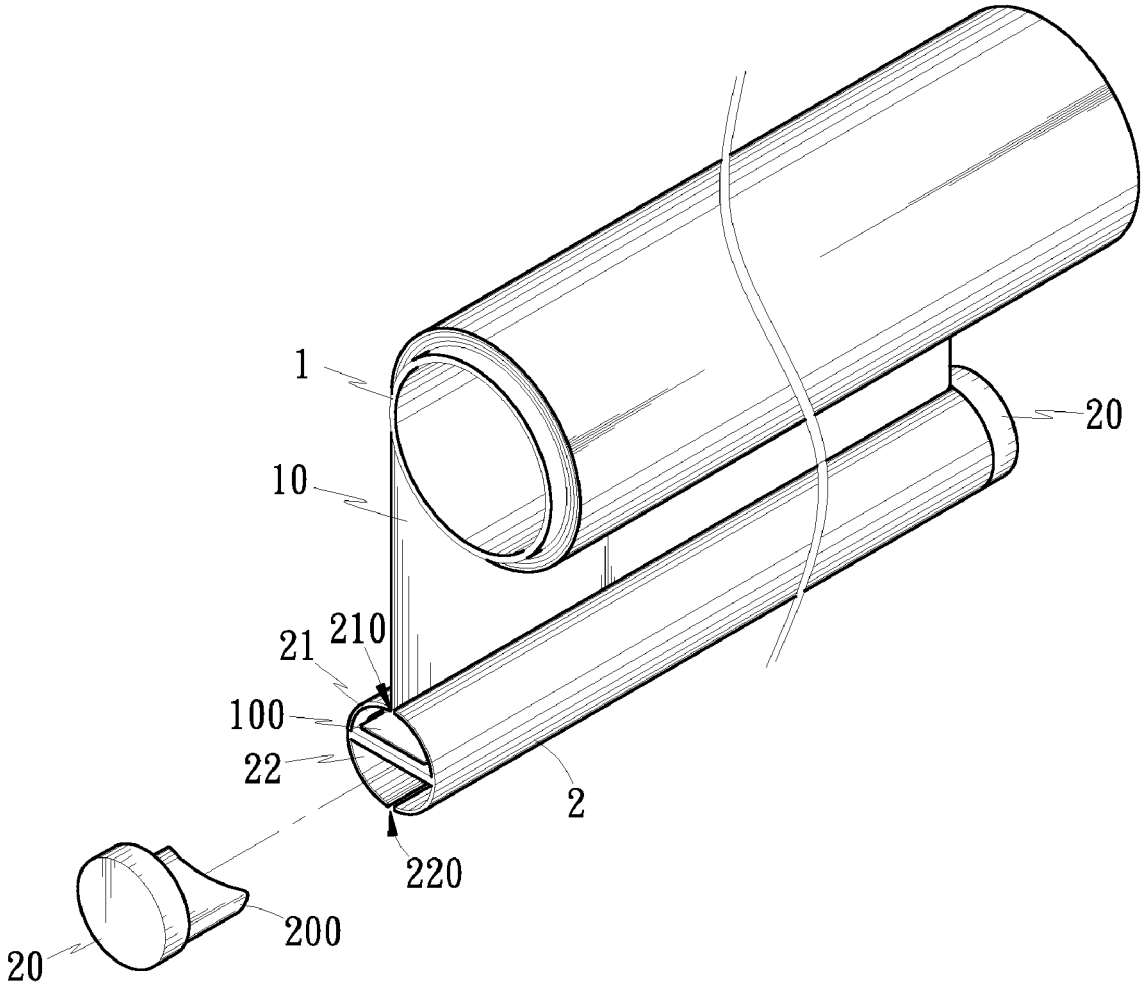
FIG. 5 is a detailed schematic view of a second tube according to an embodiment of the embodiment of the present invention.
Figure 6:
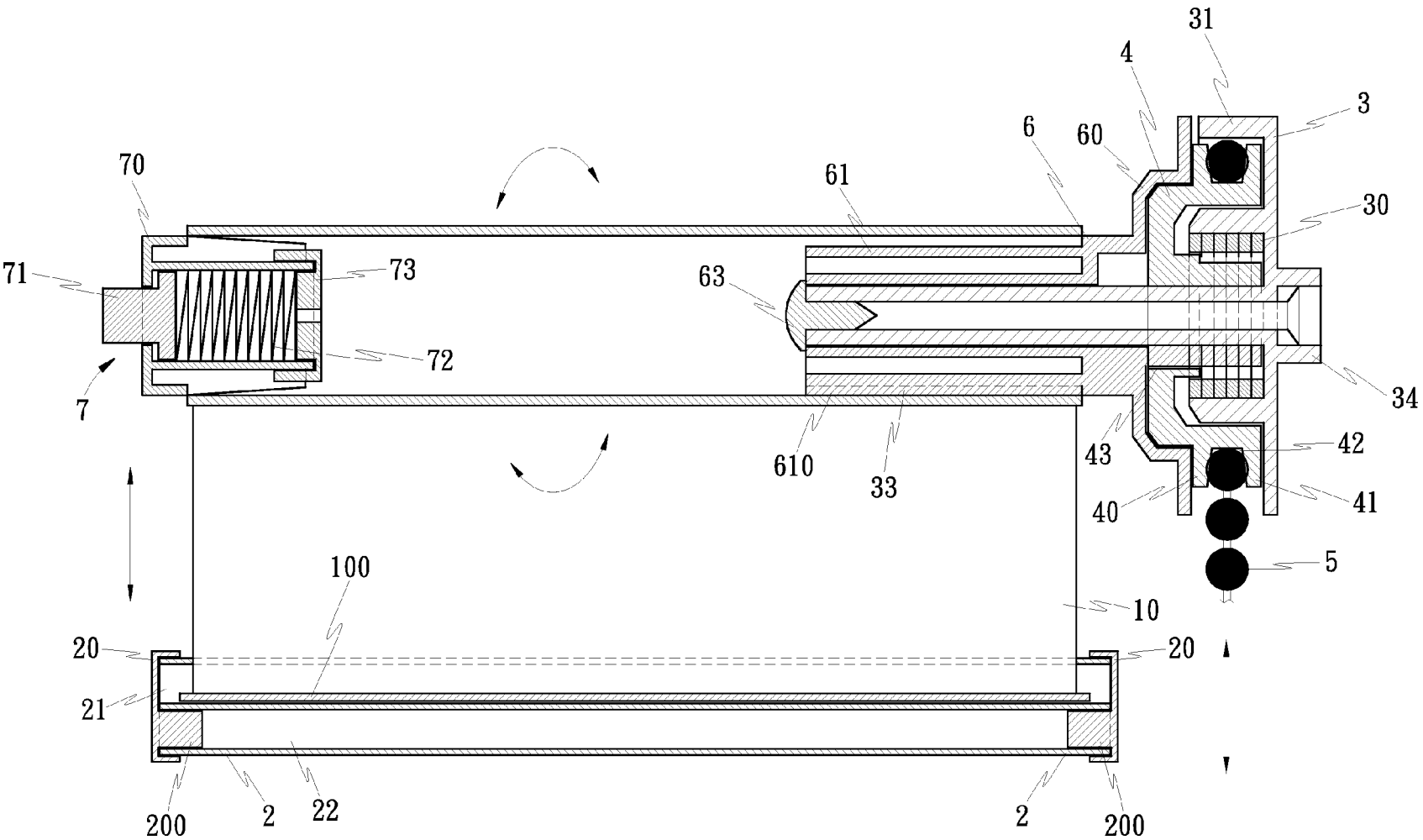
FIG. 6 is a schematic view showing the operating state of an embodiment manual banner roll-up mechanism of the present invention.

Please refer to FIGS. 5 and 6. The first tube 1 is wrapped by the foldable material 10, and another end of the foldable material 10 is adhered onto a plate 100. The plate 100 is disposed in the containment section 21 of the second tube 2, and the foldable material 10 passes through a gap 210 of the containment section 21. The second tube 2 is hollow and has two containment sections 21, 22 formed inside which respectively have a gap 210, 220. The containment sections 21, 22 and the gaps 210, 220 are used for securing the plate 100 adhered with the foldable material 10. When the plate 100 adhered with the foldable material 10 is disposed in the containment section 21, the containment section 22 is used for accepting a fourth positioning rod 200 of a second plug 20*a*. The second plug 20 is a stopper; the fourth positioning rod 200 has a semicircular shape, and is disposed in the containment section 21 or the containment section 22 of the second tube 2 to prevent the foldable material 10 from sliding out. The second tube 2 adds weight on the foldable material 10 and reduces shaking due to wind. The two ends of the first tube 1 connecting the second tube 2 and the foldable material 10 are inserted with the first plug 7, the securing cylinder 6 including the securing base 3, the washer 30, the triggering member 4 and the rope 5, and when the rope 5 is pulled to rotate the securing cylinder 6, the first tube 1 also rotates to manually roll up or out the foldable material 10.

Figure 7A:
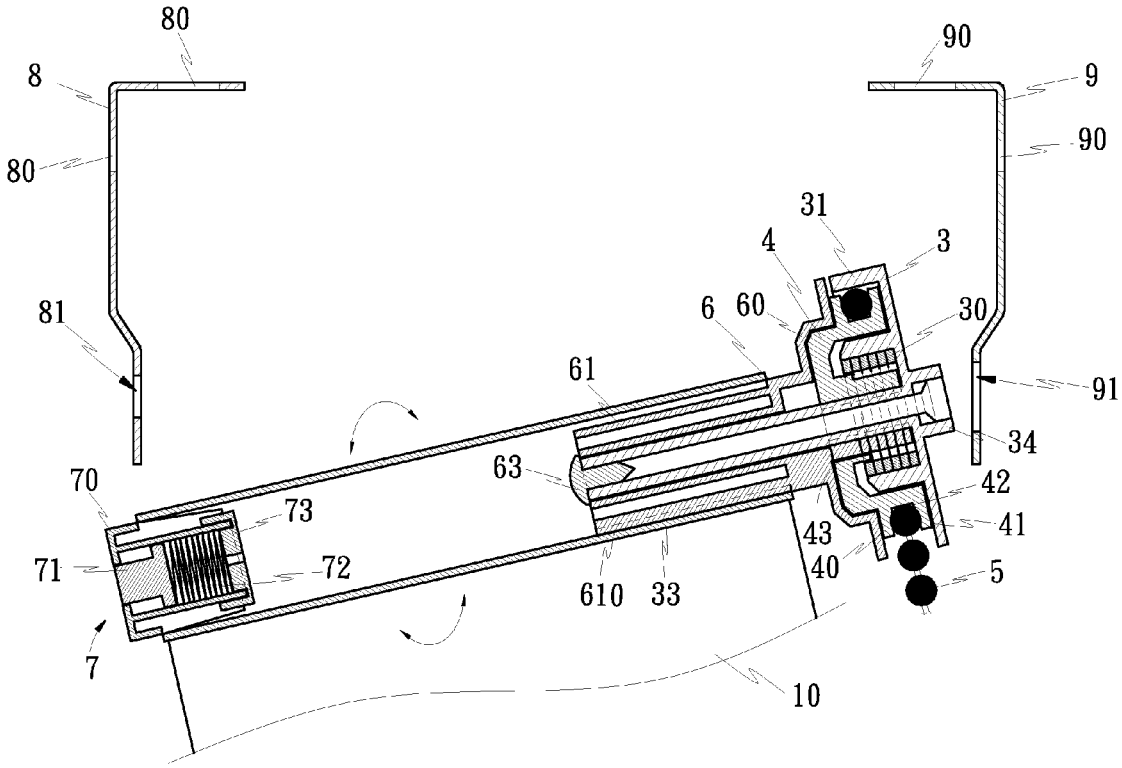
FIG. 7*a* is a schematic view showing assembly of an embodiment manual banner roll-up mechanism between two mounting supports.
Figure 7B:
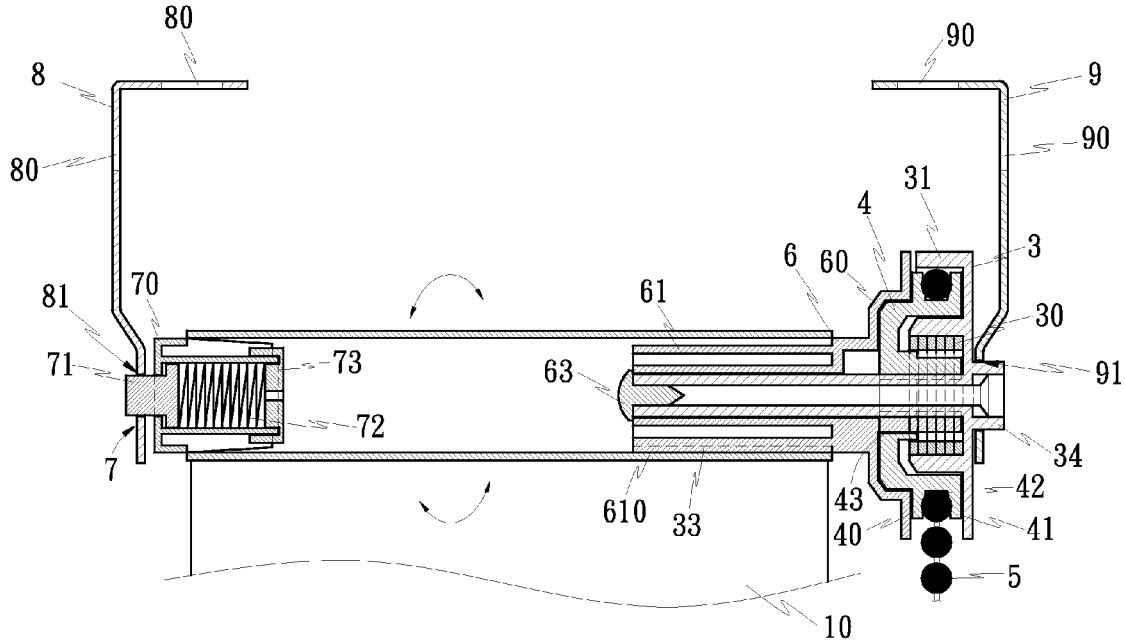
FIG. 7*b* is another schematic view showing an embodiment manual banner roll-up mechanism mounted between two mounting supports.

Please refer to FIGS. 7*a* and 7*b*. The first tube 1 installed with the first plug 7 and the securing cylinder 6 is disposed between the mounting supports 8, 9. One side of the securing base 3 of the securing cylinder 6 has the rectangular first positioning member 34; during the installation, the first positioning member 34 is inserted into the rectangular positioning aperture 91 of the mounting support 9; the second positioning member 71 of the first plug 7 at the other end of the first tube 1 is first pressed down until the second positioning member 71 is aligned with the positioning aperture 81 of the mounting support 8; the spring 72 pushes back the second positioning member 71 to engage with the positioning aperture 81 of the mounting support 8. Consequently, the first tube 1 is secured between the mounting supports 8, 9, and the rope 5 can be pulled to roll up or down the foldable material 10 around the first tube 1.

Although the present invention has been explained in relation to its preferred embodiment, it is to be understood that many other possible modifications and variations can be made without departing from the spirit and scope of the invention as hereinafter claimed.

What is claimed is:

1. A manual banner roll-up mechanism, comprising a first tube, a second tube, a foldable material, a securing base, a washer, a triggering member, a rope, a securing cylinder, a first plug and two mounting supports, characterized in that:

the first tube is rolled up with a foldable material, another end of the foldable material is connected to the second tube, one end of the first tube is jacketed by a securing base, the washer, the triggering member and the rope are locked onto the securing cylinder by a bolt, and another end of the first tube is jacketed by the first plug that has a base, a positioning member, a spring, and a cover; a first positioning member of the securing base and a second positioning member of the first plug enabling the first tube to be hung between the two mounting supports; wherein with an engagement between the rope and the triggering member movement of the rope rotates the triggering member to drive the securing cylinder to rotate the first tube, such that the foldable material is rolled up into or out of the first tube, and the second tube maintains stability of the foldable material.

2. The manual banner roll-up mechanism as claimed in claim 1, wherein the positioning member of the securing base has a rectangular shape.

3. The manual banner roll-up mechanism as claimed in claim 1, wherein the foldable material is printed or stitched with patterns.

4. The manual banner roll-up mechanism as claimed in claim 1, wherein the foldable material is made of paper.

* * * * *